US005259726A

United States Patent [19]

Bacria

[11] Patent Number: 5,259,726

[45] Date of Patent: Nov. 9, 1993

[54] ROTATING FAN GUARD

[75] Inventor: Nick N. Bacria, Longmont, Colo.

[73] Assignee: Storage Technology Corporation, Louisville, Colo.

[21] Appl. No.: 904,603

[22] Filed: Jun. 26, 1992

[51] Int. Cl.[5] ..... F04D 29/66

[52] U.S. Cl. ..... 415/119; 415/121.2; 415/220; 416/247 R

[58] Field of Search ..... 415/119, 121.2, 183, 415/220; 416/247 R

[56] References Cited

U.S. PATENT DOCUMENTS

| | | | |
|---|---|---|---|
| 2,601,947 | 7/1952 | Buttner | 415/121.2 |
| 2,720,935 | 10/1955 | Lysholm et al. | 415/119 |
| 3,261,544 | 7/1966 | Guichard | 416/247 R |
| 4,350,472 | 9/1982 | Morimoto | 415/121.2 |
| 4,768,472 | 9/1988 | Hayashi et al. | 415/119 |
| 5,131,810 | 7/1992 | Wang | 416/247 R |

*Primary Examiner*—Edward K. Look
*Assistant Examiner*—Michael S. Lee
*Attorney, Agent, or Firm*—Duft, Graziano & Forest

[57] ABSTRACT

A rotating fan guard is disclosed that prevents personal injury to people working near a rotating fan while reducing the noise level of the fan as compared to a fan with a stationary fan guard. The rotating fan guard comprises a plurality of concentric rings spaced so as to prevent the ingress of a person's finger between the rings and into contact with the fan blades. The concentric rings are attached to the fan rotor to which the fan blades are also attached. The fan guard thus rotates along with the fan blades. The rotating fan guard produces air flow having less air turbulence and less generated noise, relative to a stationary fan guard. The rotating fan guard generates mostly "white noise" which is less hazardous to human hearing than "pure tone" high frequency noise generated by prior art stationary fan guards.

13 Claims, 7 Drawing Sheets

ROTATING FAN GUARD

FIELD OF THE INVENTION

This invention relates to rotating fans and, in particular, to a fan guard attached to the rotor of an electric fan for eliminating personal injury due to contact with rotating fan blades without increasing the noise generated by the electric fan.

PROBLEM

It is a problem to provide ventilating fans which are both quiet and safe. Ventilating fans are often used in computer systems and other types of electronic products. These fans typically move high volumes of air by using rapidly rotating fan blades. The rotating blades are a potential source of personal injury to people working on the equipment containing the fans. The prior art has addressed this problem by using stationary fan guards fixedly attached to the fan housing. These stationary fan guards, however, significantly increase the audible noise generated by the fan, particularly at high audible frequencies. These prior art stationary fan guards also cause air turbulence which significantly impedes the flow of air through the fan and thus reduces the fan's efficiency.

SOLUTION

The above problems are solved and a technical advance in the art is achieved by the present invention which provides a rotating fan guard that prevents personal injury to people working near the fan while reducing the fan noise level below that of a fan with a stationary fan guard.

The rotating fan guard of the invention comprises a plurality of concentric rings arranged in coplanar fashion. The rings are spaced so as to prevent the ingress of a person's finger between the rings and into contact with the fan blades. In one embodiment, the rings are connected to each other via struts. Certain of these struts are also connected to a center disk which is attached to the fan rotor hub to which the fan blades are also attached.

In another embodiment, the rings are attached directly to the fan blades. In both of these embodiments, the fan guard rotates along with the fan blades. Even though the fan guard rotates at a high RPM, contact between a person's fingers and the fan guard will not cause personal injury.

An additional characteristic of the rotating fan guard is that it significantly reduces the turbulence of air flowing through the fan. This reduction in turbulence results in less audible generated fan noise relative to a stationary fan guard. This reduction in air turbulence also increases the efficiency of the fan so that a given size fan can move more air and provide better cooling than a fan of equivalent size using a stationary fan guard.

The rotating fan guard also generates mostly "white noise" which is less hazardous to human hearing than "pure tone" high frequency noise generated by prior art stationary fan guards.

The principle of concentric rings connected to a rotor (or other rotating hub) can also be applied to devices such as marine propellers, as well as other types of fluid impellers, to reduce the turbulence of the fluid passing through the impeller.

DETAILED DESCRIPTION

Figure 1:
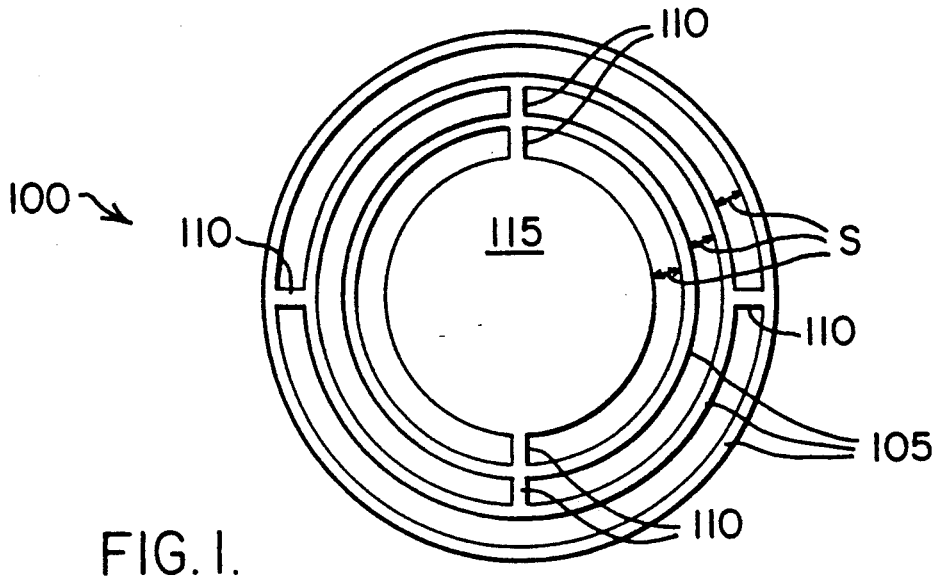
FIG. 1 illustrates one possible exemplary embodiment of the present invention.
Figure 2:
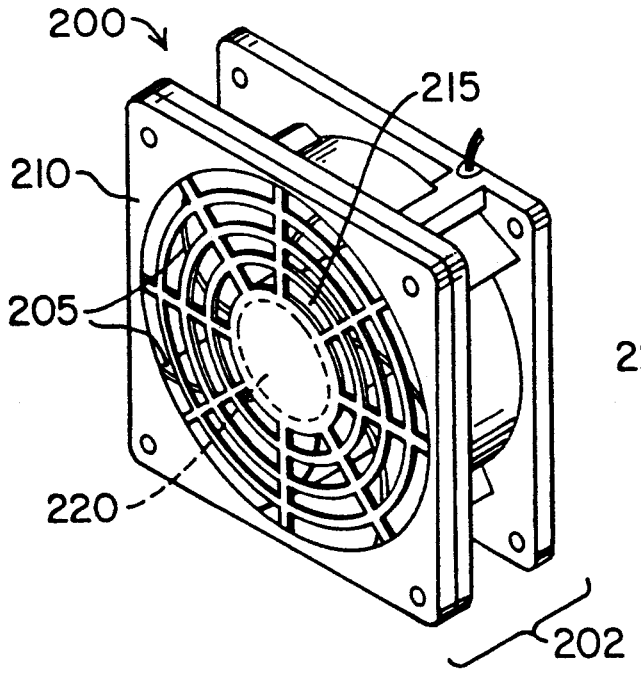
FIG. 2. PRIOR ART
FIG. 2 shows a prior art electric fan having a stationary guard.

FIG. 1 illustrates one possible exemplary embodiment of the present invention. FIG. 2 shows the prior art, comprising an electric fan 200 to which a stationary guard 210 or grate is attached. Prior art fan guards are typically attached to the fan housing 202 and are stationary with respect to the rotating fan blades 205. The rotating fan guard 100 comprises a plurality of concentric guard rings 105 which are attached to a fan rotor hub 220 or to the fan blades 205. Rings 105 are connected to each other by radial struts 110, at least two of which are attached to a center disc 115. The spacing S between guard rings 105 can be varied to prevent the ingress of foreign objects of any desired size. Because the spacing S between rings 105 varies with application-specific requirements, the number of guard rings 105 in a given fan guard 100 is not critical and can vary from two to 10 or more.

Figure 3:
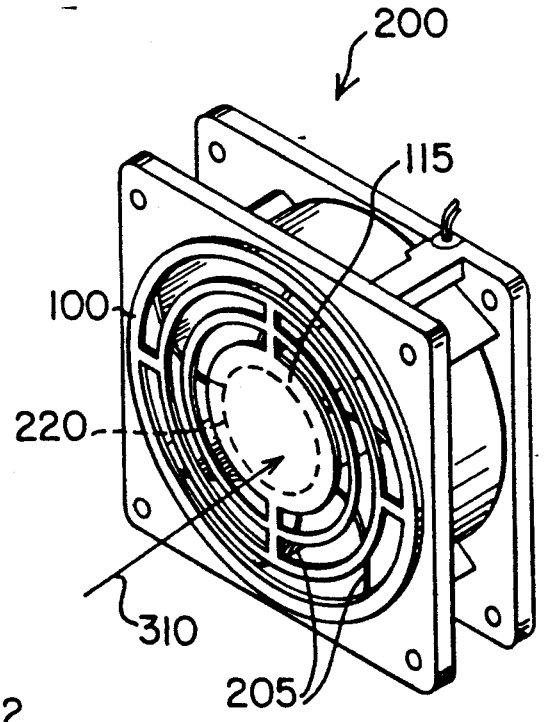
FIG. 3 illustrates a rotating fan guard attached to an electric fan.

FIG. 3 illustrates the rotating fan guard 100 attached to an electric fan 200. In this embodiment, rotating fan guard 100 is connected to fan 200 by attaching center disk 115 of fan guard 100 to hub 220 of the fan rotor 215 on the intake side of the fan 200. Fan guard 100 rotates in synchronism with rotor 215 and fan blades 205. Air flow through the fan 200 is in direction 310.

The concentric guard rings 105 of fan guard 100 are spaced closely enough to prevent the fingers of maintenance personnel from passing between the guard rings 105 and contacting the rotating fan blades 205.

Figure 15:
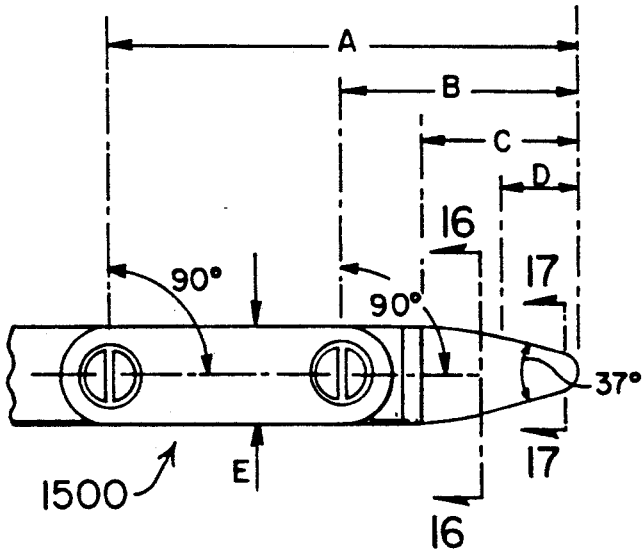
FIGS. 15 through 17 show a "UL finger"
Figure 16:
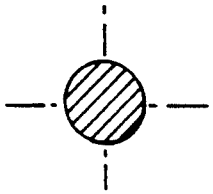
Figure 17:
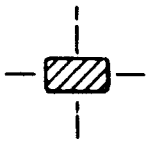

FIG. 15 shows an Underwriter's Laboratories (IEC 529) "test finger" 1500, hereinafter referred to as a "UL finger" 1500. In FIG. 15, A=60 millimeters (mm), B=30 mm, C=20 mm, and D=10 mm. The diameter of UL finger 1500 at cross section E—E is 12 mm. FIG. 16 is cross section taken through line 16—16 of FIG. 15. FIG. 17 is a cross section taken through line 17—17 of FIG. 15.

In order to comply with UL requirements, the spacing S between rings 105 must be such that a "UL finger" 1500 cannot pass between the rings 105. Therefore, the spacing S in one embodiment of the present invention is approximately 0.3 inches or less.

The fan guard 100 is typically used with an electric fan 200 such as an EBM Industries type W2G 107. This fan 200 has a blade diameter of approximately 4.15 inches, and an airflow of approximately 100 cubic feet per minute when rotating at 2700 RPM. The outer diameter of the rotating fan guard 100 is typically the same as the fan blade diameter. The guard outer diameter is not critical as long as ingress of a person's fingers (or other foreign objects) into the fan blades 205 is prevented.

It should also be noted that concentric rings 105 also function to effect laminar air flow and noise attenuation when located on the exhaust side of a fan 200. This is particularly important when a fan 200 with a reversing motor is used.

Figure 5:
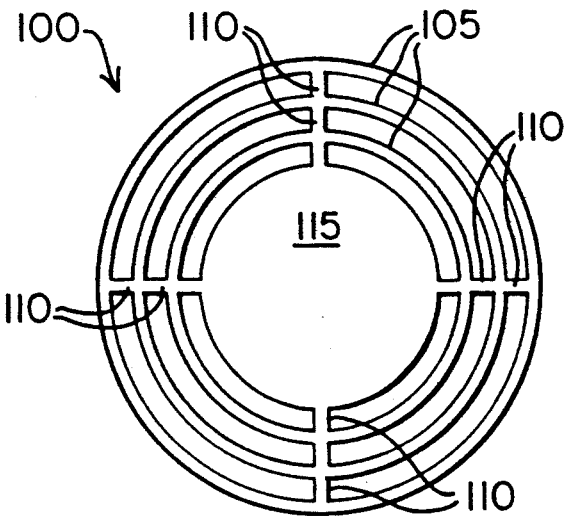
FIGS. 4, 5 and 7 illustrate alternative embodiments wherein different numbers and configurations of struts are employed to connect the concentric rings of the fan guard to each other.
Figure 4:
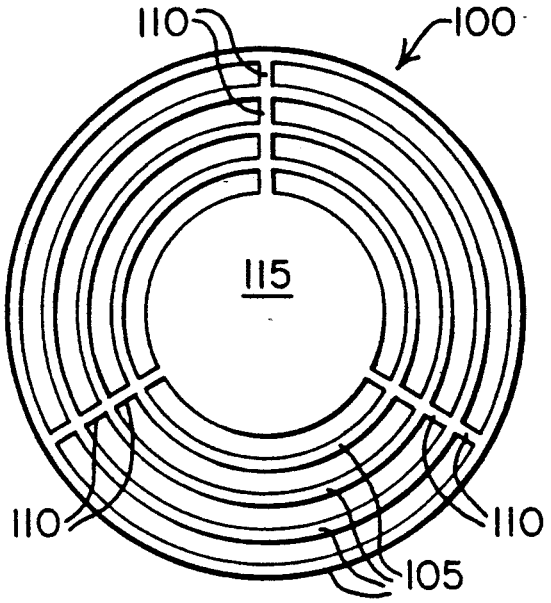
Figure 7:
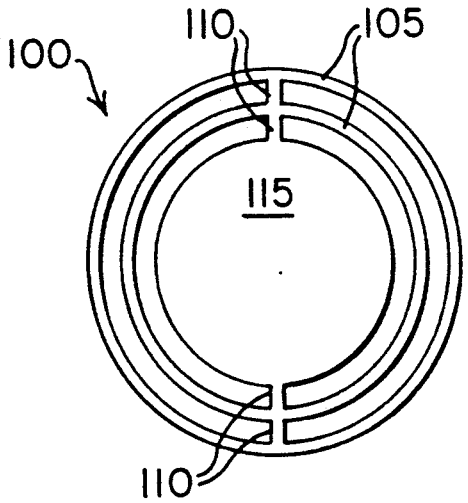

FIGS. 4, 5, and 7 illustrate alternative embodiments wherein different numbers and configurations of struts 110 are employed to connect the concentric rings 105 of the fan guard 100 to each other. FIG. 4 shows an embodiment with three struts 110, and FIG. 5 shows an embodiment with four struts 110. For most applications, the minimum number of struts 110 is preferably at least three. At least four or more struts 110 are desirable in cases wherein the rigidity of each strut is minimal due to a minimal strut thickness. Other arrangements of struts 110 could also be used to connect guard rings 105. The two strut arrangement shown in FIG. 7 is suitable for small fans having diameters typically less than 3 inches.

The spacing S between guard rings 105 is not critical, except insofar as preventing the ingress of foreign objects of predetermined size. The minimum dimension of a given foreign object determines the spacing S between guard rings 105. The number of guard rings 105 is not critical, but the fewer the number of rings 105, the more efficient the operation of the fan 200.

Figure 6:
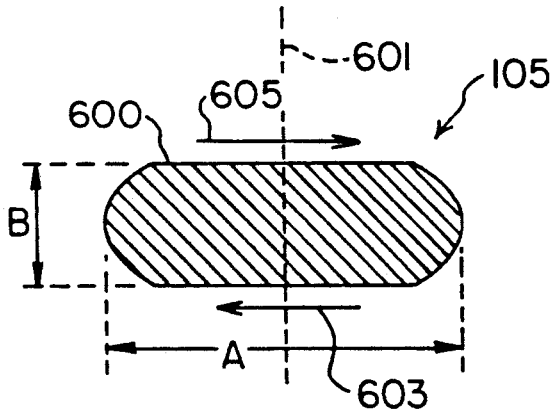
FIG. 6 illustrates a typical cross section of a guard ring 600 used in one exemplary embodiment of the invention.

FIG. 6 illustrates a typical cross section of a guard ring 600 used in one exemplary embodiment of this invention. Line 601 indicates the center of the plane formed by concentric rings 105, which plane is parallel to the plane of rotation of the fan blade. Arrow 603 points toward the outside of guard rings 105. Arrow 605 indicates the direction of airflow relative to the ring. Since the cross section of this ring is symmetrical, the airflow could be in the opposite direction from arrow 605, in which case, the ring would still function effectively. In this embodiment, Vertical dimension A is approximately to 0.115 inches and horizontal dimension B is approximately to 0.062 inches. These cross sectional dimensions are not critical, and other dimensions and ratios could be used to provide the benefits of the present invention.

Figure 8:
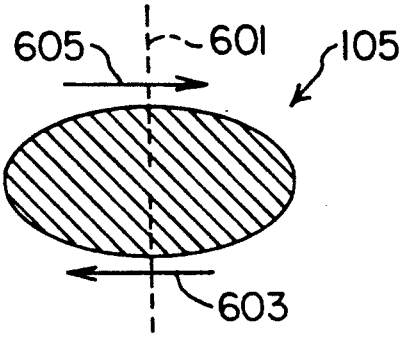
FIGS. 8 through 10 illustrate further alternative embodiments of guard ring cross sections.
Figure 9:
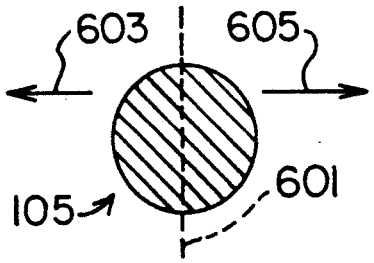
Figure 10:
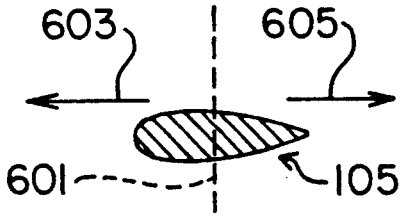

FIGS. 8 through 10 illustrate further alternative embodiments of guard ring cross sections. In each of FIGS. 8 through 10, line 601 represents the center of the plane of concentric rings 105, which is parallel to the plane of rotation of the fan blade; arrow 603 points toward the outside of guard rings 105; and arrow 605 indicates the direction of airflow.

FIG. 8 shows a guard ring 105 having a substantially elliptical cross section.

FIG. 9 is applicable to a situation wherein a material having a circular cross section, such as a wire or a rod, is used to form guard rings 105.

FIG. 10 shows essentially a symmetrical airfoil. This type of guard ring cross section may be used to effect a significant reduction in the turbulence of the air flow in specific situations.

Figure 11:
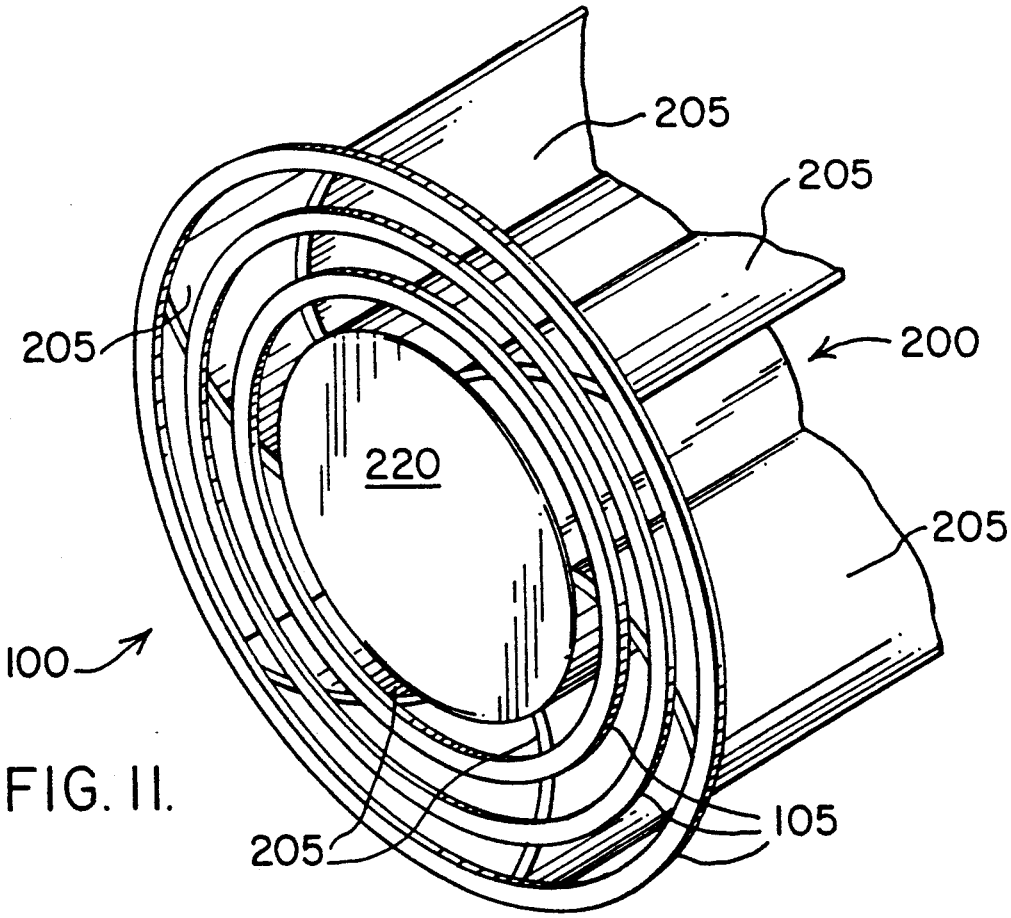
FIG. 11 illustrates a further alternative embodiment of the present invention.

FIG. 11 illustrates a further alternative embodiment of the present invention. In this embodiment, the rotating fan guard 100 is integrated into the fan construction by being attached to the fan blades 205. Therefore, no struts are used to connect the concentric guard rings 105. This integrated construction simplifies production of the fan/fan guard unit 200/100, and provides a more stable positioning of guard rings 105 relative to the fan blades 205. This integrated construction also reduces the air turbulence caused by the struts 110 used in the other embodiments of the invention.

Comparison of Generated Noise—Rotating Guard vs. Prior Art Stationary Guard

The electric fans 200 typically used for cooling and ventilation in electronic products are relatively small units between four and five inches in diameter. This type of fan 200 is capable of moving high volumes of air in a given period of time. This results in the generation of a significant amount of audible noise when fans 200 are used with conventional stationary guards 210. The audible noise generated by a fan 200 with the rotating fan guard 100 of the present invention is significantly less than that of a fan 200 having a stationary fan guard 210. The rotating fan guard 100 provides this relative noise reduction with a minimal reduction in the air flow through the fan 200.

Figure 12:
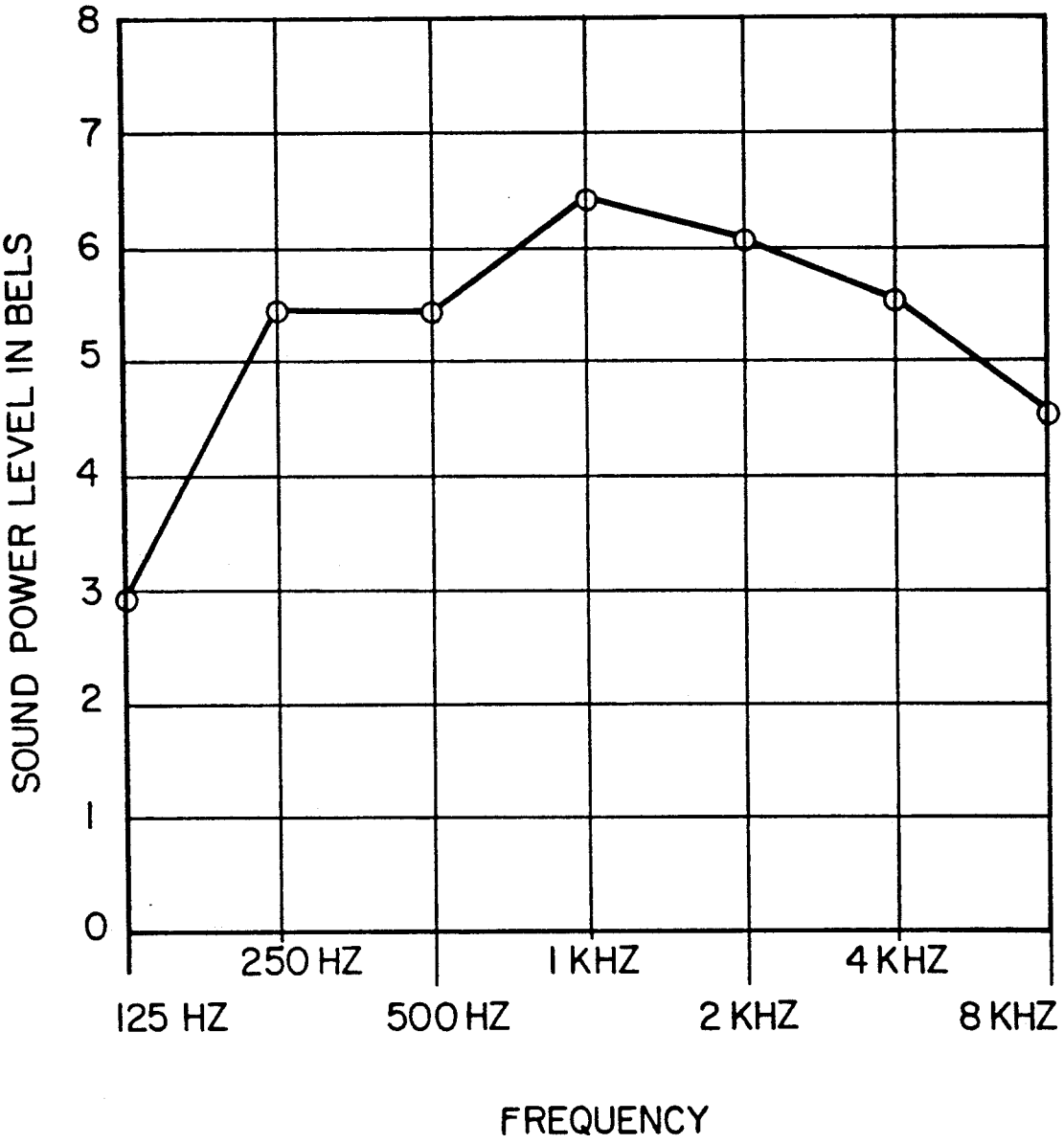
FIGS. 12 and 13 are graphs which provide a noise level comparison between a typical fan equipped with a prior art stationary guard and a fan using a rotating fan guard.
Figure 13:
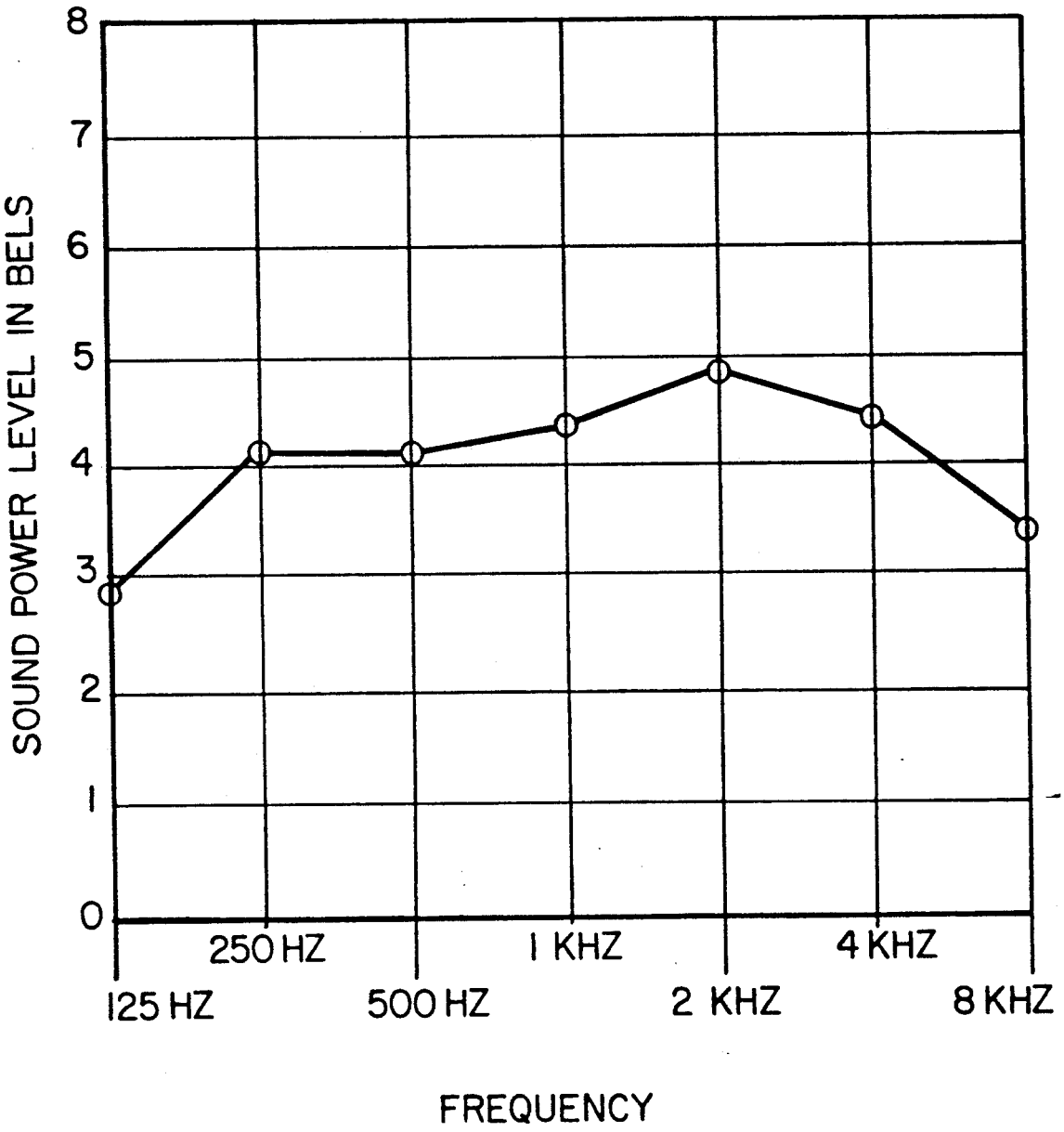

FIGS. 12 and 13 ar graphs which provide a noise level comparison between a typical fan 200 equipped with prior art stationary guards 210 and a fan 200 using a rotating guard 100 in accordance with the present invention. Both of these graphs show A-weighted sound power level in Bels (relative to 1 picowatt) produced by a given fan 200 as a function of frequency. "A-weighted" sound power levels are weighted to the audio spectrum of a typical human ear, and reflect a sound power level spectrum to which the human ear is more sensitive than an unweighted sound power spectrum.

More specifically, each of the graphs in FIGS. 12 and 13 show noise level measurements taken with am EBM Industries Model W2G107-AD03 fan 200. The graph in FIG. 12 shows measurements made with the above type fan 200 having a typical stationary guard 210 on both the intake and exhaust sides of the fan 200. The graph in FIG. 13 shows measurements made with the same type fan 200 having a rotating guard 100 on the intake side and a stationary guard 210 (identical to the guards used in FIG. 7) on the exhaust side of the fan 200.

It can readily be seen from a comparison of the graphs in FIGS. 12 and 13, that fan 200 with the rotating fan guard 100 is quieter and generates a more desirable noise spectrum than the fan with the stationary guard. The rotating fan guard 100 generates mostly "white noise" at a lower total noise level which is less hazardous to human hearing than the relatively "pure tone" high frequency noise concentrated around 1 kilohertz which is generated by the same fan 200 using stationary fan guards 210. The total noise power across the audio spectrum between 125 hertz and 8 kilohertz was measured at 5.18 Bels for fan 200 with the rotating guard 100 as compared to 6.67 Bels for the same fan 200 with the stationary guards 210.

Typical electronic enclosures contain more than one cooling fan 200. In applications involving these electronic enclosures the cumulative noise reduction achieved by the present invention can be substantial.

Figure 14:
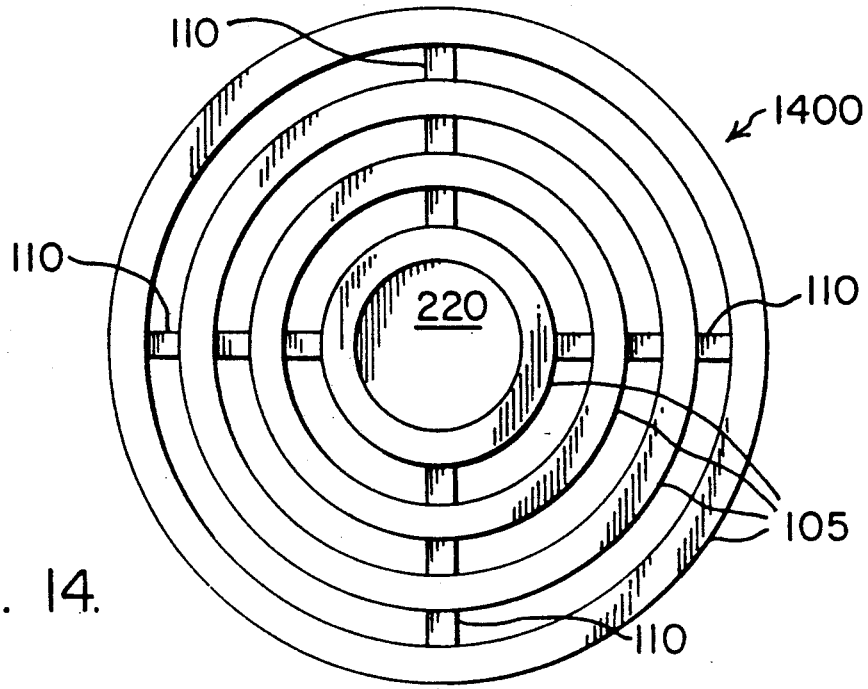
FIGS. 14 and 18 illustrate a further alternative embodiment of the present invention wherein the guard rings are arranged in a conical fashion.
Figure 18:
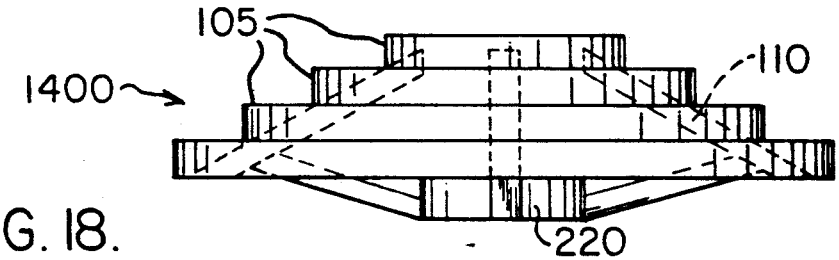

FIGS. 14 and 18 illustrate an alternative embodiment of the present invention wherein concentric rings 105 of guard 1400 are arranged in a conical pattern. In this embodiment, diagonal struts 110 connect rings 105 to each other and to hub 220.

Other applications exist for the use of this rotating fan guard 100 in addition to use in electronic equipment. These other uses include any situation wherein protection from impeller or propeller blades 205 is required, with minimum disturbance of the fluid flow through the fan 200.

Figure 19:
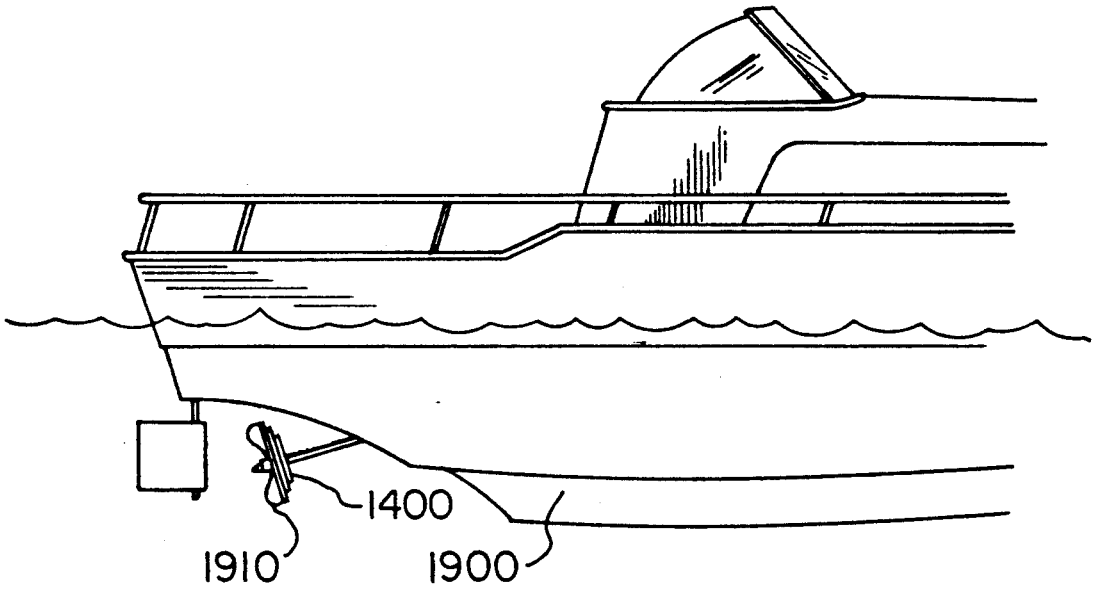
FIG. 19 shows a rotating guard attached to a boat propeller.

FIG. 19 shows a conical fan guard 1400 attached to the propeller 1910 of a boat 1900. The rotating fan guard 100 of this invention could also be attached to an airplane propeller hub (not shown). Fan guard 100 or 1400 also functions with fans 200 or propellers 1910, respectively, having diameters of 12 inches or more.

It is to be expressly understood that the claimed invention is not to be limited to the description of the preferred embodiment but encompasses other modifications and alterations within the scope and spirit of the inventive concept.

I claim:

1. Fan apparatus for use with a fan having a plurality of fan blades attached to a rotor of said fan, said fan apparatus comprising:

noise reduction means for minimizing audible noise generated when said plurality of fan blades are rotated; and fastening means for rigidly attaching said noise reduction means to said rotor so that said noise reduction means rotates together with said plurality of fan blades, wherein said noise reduction means includes a plurality of concentric rings whose common centers are coaxially disposed with respect to the axis of rotation of said rotor, and wherein a plane formed by said plurality of concentric rings is oriented parallel to the plane of rotation of said plurality of fan blades.

2. The apparatus of claim 1, wherein said plurality of concentric rings have a predetermined spacing therebetween to prevent the ingress of a foreign object through said rings into said plurality of fan blades.

3. The apparatus of claim 2, wherein said predetermined spacing is less than a cross-sectional dimension of a UL FINGER to prevent said ingress thereof.

4. The apparatus of claim 1, wherein said plurality of concentric rings is equal to at least two.

5. The apparatus of claim 1, wherein said fastening means includes a plurality of struts connecting said plurality of concentric rings in a plane parallel to the rotational plane of said plurality of fan blades.

6. The apparatus of claim 1, wherein said fastening means includes 3 struts connecting said plurality of concentric rings in a plane parallel to the rotational plane of said plurality of fan blades.

7. Fan apparatus for use with a fan having a plurality of fan blades rigidly attached to a rotor, said fan apparatus comprising:

a plurality of concentric rings whose common centers are coaxially disposed with respect to the axis of rotation of said rotor, and wherein a plane formed by said plurality of concentric rings is oriented parallel to the plane of rotation of said fan blades; and a plurality of struts connecting said plurality of concentric rings and rigidly attaching said plurality of said concentric rings to said rotor.

8. The apparatus of claim 7, wherein said concentric rings are located on the intake side of said fan.

9. The apparatus of claim 7, wherein said plurality of struts is equal to at least 2.

10. The apparatus of claim 7, wherein said plurality of said concentric rings is equal to two.

11. The apparatus of claim 7, wherein the spacing between said concentric rings is less than a predetermined distance to prevent the ingress of a foreign object having a dimension equal to or greater than said predetermined distance.

12. The apparatus of claim 7, wherein the spacing between said concentric rings is less than a cross-sectional dimension of a UL FINGER.

13. The apparatus of claim 7, wherein said plurality of concentric rings are arranged to form a conical pattern wherein the plane of rotation of each of said plurality of rings is parallel with respect to said plane of rotation of said fan blades.

* * * * *